US006719484B1

(12) United States Patent
Johnson

(10) Patent No.: US 6,719,484 B1
(45) Date of Patent: Apr. 13, 2004

(54) MARKER SUPPORT

(76) Inventor: Robert F. Johnson, 3130 Pinole Valley Rd., Pinole, CA (US) 94564

( * ) Notice: Subject to any disclaimer, the term of this patent is extended or adjusted under 35 U.S.C. 154(b) by 0 days.

(21) Appl. No.: 10/294,566

(22) Filed: Nov. 15, 2002

(51) Int. Cl.[7] ..... E01F 9/011

(52) U.S. Cl. ..... 404/10; 116/63 P; 256/13.1; 40/612

(58) Field of Search ..... 404/6, 9, 10, 11, 404/12, 13; 116/63 R, 63 P, 63 C; 256/1, 13.1; 40/612, 606.01, 607.1

(56) References Cited

U.S. PATENT DOCUMENTS

| | | | | |
|---|---|---|---|---|
| 1,755,443 A | | 4/1930 | Hartzler et al. | 404/10 |
| 3,843,079 A | * | 10/1974 | Reisling | 248/530 |
| 3,875,720 A | * | 4/1975 | Russell | 52/736.3 |
| 4,084,914 A | | 4/1978 | Humphrey et al. | |
| 4,092,081 A | | 5/1978 | Schmanski | |
| 4,240,766 A | | 12/1980 | Smith et al. | 404/10 |
| 4,269,534 A | | 5/1981 | Ryan | 404/10 |
| 4,486,117 A | * | 12/1984 | Blau | 404/10 |
| 4,522,530 A | | 6/1985 | Arthur | 404/10 |
| 4,636,108 A | | 1/1987 | Duckett | 404/10 |
| 4,645,168 A | | 2/1987 | Beard | 248/548 |
| 5,197,819 A | | 3/1993 | Hughes | 404/13 |
| 5,267,523 A | | 12/1993 | Hugron | 116/63 R |
| 5,452,965 A | | 9/1995 | Hughes, Sr. | 404/10 |
| 5,484,217 A | | 1/1996 | Carroll et al. | |
| 5,518,337 A | | 5/1996 | Modlin | 404/10 |
| 5,560,732 A | | 10/1996 | Kulp et al. | |
| 5,670,954 A | | 9/1997 | Junker | |
| 5,788,405 A | | 8/1998 | Beard | 404/10 |
| 6,053,658 A | | 4/2000 | Gibson, Jr. | 404/10 |
| 6,182,600 B1 | | 2/2001 | Brown et al. | 116/63 C |

* cited by examiner

*Primary Examiner*—Robert E. Pezzuto
*Assistant Examiner*—Alexandra K. Pechhold
(74) *Attorney, Agent, or Firm*—Theodore J. Bielen, Jr.

(57) ABSTRACT

A marker support for use on a ground surface utilizing a base member having a flexible body. The base member includes a first surface with a plurality of flaps which extend outwardly from the same. The second surface is intended to contact the ground. An upright member is positioned to extend outwardly from the first surface and includes an area for accommodating the plurality of flaps. The plurality of flaps are linked to the base member by an element located within the recess.

10 Claims, 2 Drawing Sheets

MARKER SUPPORT

BACKGROUND OF THE INVENTION

The present invention relates to a novel and useful stanchion support of high durability.

Markers or stanchions are commonly used on roadways and other surfaces to denote hazards, lanes of traffic, areas where traffic is prohibited, and the like. Such markers are normally referred to as delineators or channelizers. The latter is a slimmer structure of a delineator.

Such delineators or channelizers are often placed in the vicinity of traffic, they tend to impact with vehicles. In the past, these markers have been constructed of flexible or resilient materials. However, even this expedient has not prevented damage to such markers, which generally occurs between the meeting of the base member and the upright portion of the same.

In the past, marking posts or stanchions have been devised to accommodate impact forces from vehicles and other moving objects. For example, U.S. Pat. No. 5,484,217 shows a restorable breakaway post which includes a placeable splice plate.

U.S. Pat. Nos. 4,084,914, 4,092,081, 4,522,530, and 5,670,954 describe traffic delineators or markers which employ flexible or resilient portions to aid in the absorbing of impact forces.

U.S. Pat. No. 5,560,732 describes a safety delineator which is provided with a support base which is filled with ballast material to aid in crush resistance characteristics.

A marker support for use on a ground surface which is resistant to impact forces would be a notable advance in the transportation field.

BRIEF SUMMARY OF THE INVENTION

In accordance with the present invention a novel and useful marker support for use on a ground surface is herein provided.

The marker support of the present invention utilizes a base member. The base member is formed of a flexible material and has a first surface and an opposite second surface. The second surface is intended to contact the ground. Such contact may include the provision of an adhesive or other fastening means to hold the second surface of the base member to the ground. If the first surface lies above the ground and includes a plurality of resilient flaps which extend outwardly from and are connected to the base member first surface. The base member may be formed of resilient material which may be identical to the material forming the plurality of flaps connected to and extending outwardly from the base member.

An upright member is also found in the present invention and is positioned to extend outwardly from the first surface of the base member. The upright member is also constructed with a recess which may accommodate the plurality of resilient flaps extending from the first surface of the base member. The resilient flaps may also connect to the exterior of the upright member. The recess also serves to hold the marker which is used in conjunction with the support of the present invention.

Means is also found in the present invention for resiliently linking the base member to the upright member. Such means may take the form of an element located within the recess of the upright member. Such element may be in the form of an endless member such as a square, ring, and the like. Fastening means holds the element to the plurality of resilient flaps extending from the first surface of the base member. Such fastening means may take the form of screws, nails, adhesives, welding, and the like. In any case, the upright member is connected to the base member by the use of linking means and provides a resilient or flexible connection which permits the support of the present invention to support a marker which is highly resistant to impact.

It may be apparent that a novel and useful marker support has been hereinabove described.

It is therefore an object of the present invention to provide a marker support which is sturdy and highly resistant to impact forces imparted by a vehicle.

Another object of the present invention is to provide a marker support which is usable on roadways and other surfaces which may be fixed to said surface for long periods of time without replacement.

Another object of the present invention is to provide a marker support for use on a transportation throughway which is easy to manufacture and repair and may be employed in a portable or fixed manner.

Yet another object of the present invention is to provide a marker support for use on a ground surface which may be employed as a delineator or a channelizer, as the case may be.

Another object of the present invention is to provide a marker support which employs material that has been recycled from prior channelizers or delineators.

The invention possesses other objects and advantages especially as concerns particular characteristics and features thereof which will become apparent as the specification continues.

For a better understanding of the invention reference is made to the following detailed description of the preferred embodiments thereof which should be taken in conjunction with the prior described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior described drawings.

Figure 1:
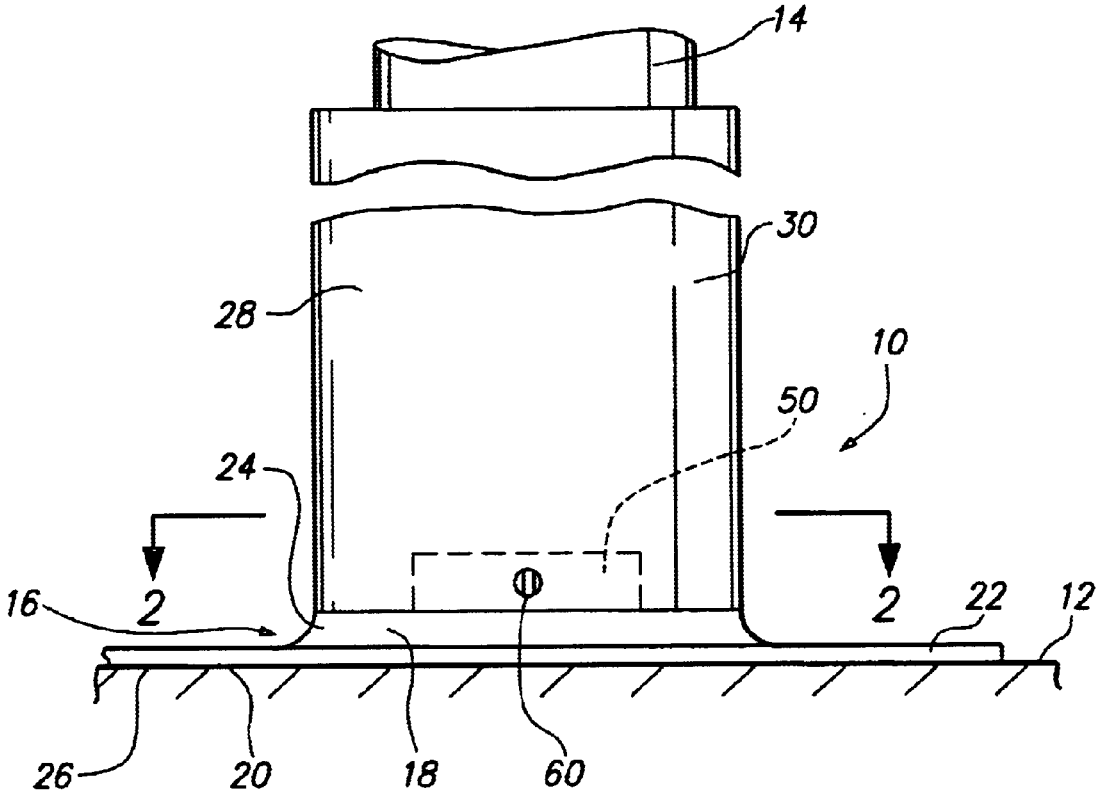
FIG. 1 is a partial front elevational view of the support of the present invention on a ground surface.

The invention as a whole is shown in the drawings by reference character 10. Support 10 is employed relative to a ground surface 12 and used to support a marker 14 commonly found in traffic areas such as roadways, parking lots, airports, and the like. Marker 14 may take the form of a delineator, channelizer, and other items which are intended to mark roadways, hazards, or prevent the flow of traffic of vehicles in certain areas. Support 10 includes as one of its elements a base member 16. Base member 16 includes a first surface 18 and a second surface 20 which is intended to contact ground surface 12. Base member 16 is provided with a relatively flat portion 22 and a truncated, hollow cylindrical portion 24. Aperture 25 is also found in cylindrical portion 24. Adhesive layer 26, shown partially in FIG. 1, may also be employed to firmly fasten second surface 20 of support 10 to ground surface 12. Of course, other fastening means may be employed such as screws, bolts, welds, and the like, to achieve this result. However, when base member 16 is so positioned, the upper portions of support 10 and marker 14 are susceptible to impact damage from moving vehicles.

Support 10 also includes upright member 28 which is in the form of a cylinder in the preferred embodiments shown in the drawings. Of course, upright member 28 may take other cross-sectional configurations such as rectangular, triangular, and like patterns. Upright member 28, as well as base member 16, are formed of flexible and resilient material. Also, this material may take the form of recycled rubber derived from automobile tires. Such material may be laminated and combine with cloth or other materials to provide toughness and durability to support 10. Upright member 28 includes an outer surface 30 and an inner surface 32, FIG. 2. Chamber or recess 34 lies within upright member 28 and is intended to accommodate marker 14 of varying colors, sizes, and shapes.

Figure 2:
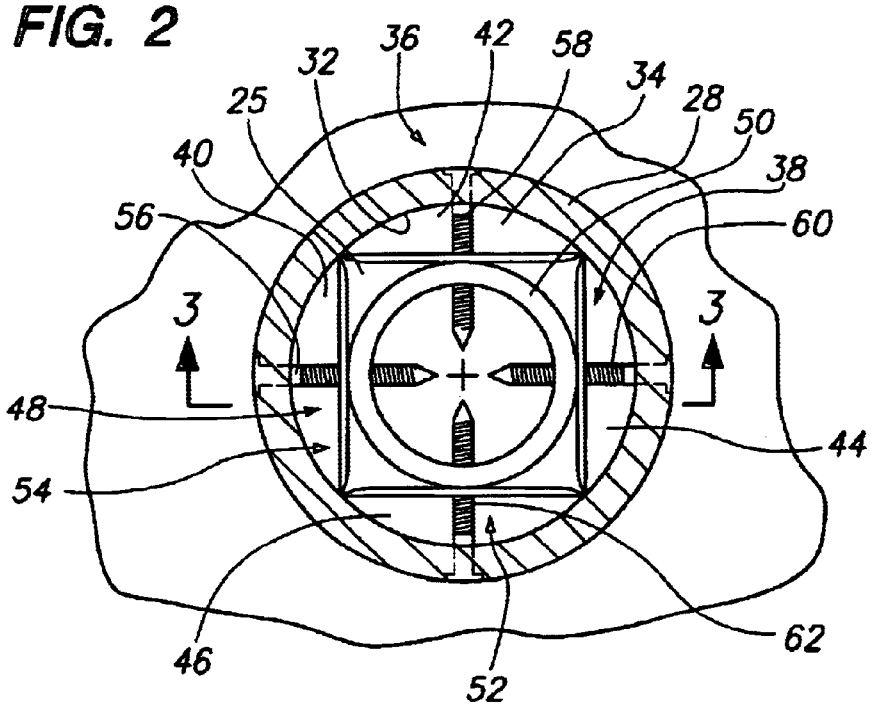
FIG. 2 is a sectional view taken along line 2—2 of FIG. 1.
Figure 3:
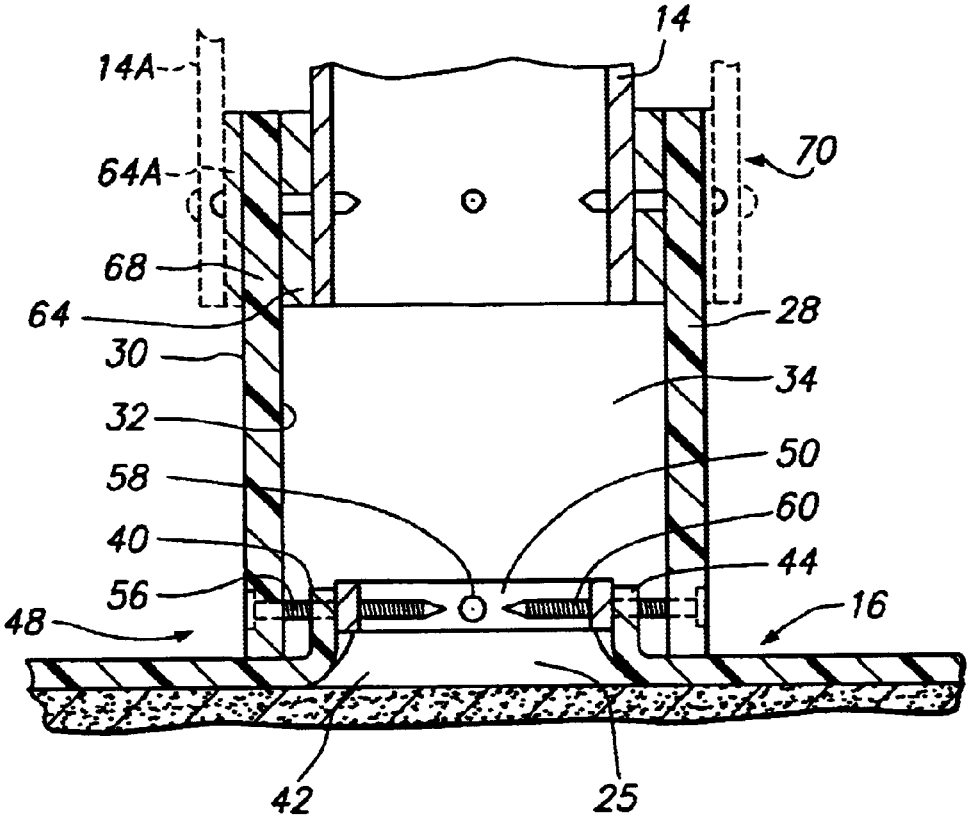
FIG. 3 is a sectional view taken along line 3—3 of FIG. 2.

A plurality of resilient flaps 36 connect to base member 16 and extend outwardly therefrom for connection to upright member 28. For example, flaps 40, 42, 44, and 46 are shown in FIG. 2 in this regard extending into recess 34, although such flaps 36 may lie on outer surface 30. Flaps 40, 42, 44, and 46 may also be formed integrally with base member 16. Moreover, plurality of flaps 38 may also be formed separately from base member 16 and then connected thereto by suitable fastening means. In any case, the embodiment 10 shows plurality of flaps 38 extend into recess 34 and lie in the vicinity of inner surface 32 of upright member 28. Means 48 is depicted in FIGS. 2 and 3 as linking base member 16 to upright member 28. Means 48 includes element 50 which is shown in the form of a ring. Fastening means 52 holds element 50 to plurality of resilient flaps 38. Fastening means 52 includes a plurality of screws 54 which penetrate upright member 28, plurality of flaps 38 and element 50. For example, screws 56, 58, 60 and 62 are shown in the drawings as performing the function of fastening means 52. It should be noted that plurality of screws 54 are removable to change the configuration of upright member 28. That is to say, recess or chamber 34 may be altered to accommodate a marker 14 which is of varying degrees of thickness or slimness. Ring 64 and fasters 70, FIG. 3, hold marker 14 within chamber 34. However a marker 14A may lie outside surface 30 of upright member 28, necessitating the use of ring 64A. Marker 14 may be described as a channelizer while marker 14A is known as a delineator. Also, upright member 28 may be replaced as necessary to alter the color of surface 30 or provide surface characteristics such as reflectivity with respect to surface 30, as the case may be. Further, rings 64 or 64A, upright member 28, and base member 16 may be molded into a single unit. In addition, markers 14 or 14A, upright member 28 and rings 64 or 64A may be formed as a unit.

Figure 4:
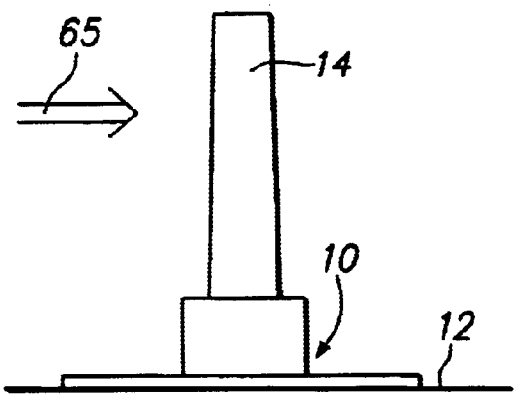
FIG. 4 is a schematic view of the support of the present invention in use with a marker being subjected to impact forces.
Figure 5:
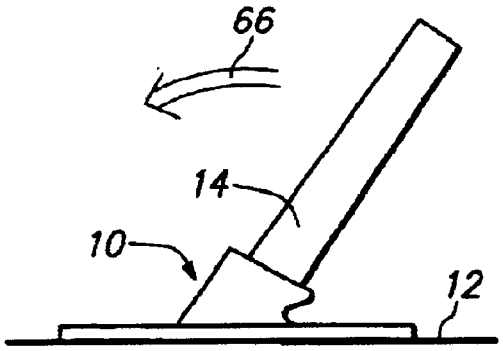
FIG. 5 is a schematic view the support of the present invention being used with a marker which is recovering from the impact force depicted in FIG. 4.

In operation, support 10 is assembled by connecting upright member 28 to base member 16 by the use of linking means 48. That is to say, plurality of screws 54 penetrate upright member 28, plurality of flaps 38, and element 50, best shown in FIGS. 2 and 3, flaps 38 are depicted in FIGS. 2 and 3 as extending outwardly from aperture 25 of base member 16, in this regard. Upright member 28 may take various forms but is used to accommodate marker 14 which extends outwardly from upright member 28. Marker 14 is used to flag or show a traffic lane, hazard, and the like. It has been found that plurality of resilient flaps 38, through linking means 48, is particularly durable in receiving impact forces such as that shown in FIG. 4. Although a certain deformation of support 10 occurs, FIG. 5, support 10 returns to its original configurations, FIG. 4 when impact force, directional arrow 64 is removed. Directional arrow 66, FIG. 5 indicates the return of support 10 to the configuration shown in FIG. 4.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A marker support for use on a ground surface, comprising:

a. a base member, said base member comprising a flexible body having a first surface and a second surface contacting the ground surface, said base member further including a plurality of resilient flaps connected to and extending outwardly from said base member first surface;

b. an upright member, said upright member positioned to extend outwardly from said first surface of said base member; said upright member including a recess and means for accommodating the marker, in a position apart from said base member; and c. means for resiliently linking said base member to said upright member, said means including an element located in said recess and fastening means for holding said element to said plurality of resilient flaps, and said upright member.

2. The support of claim 1 in which said recess surrounds a majority portion of the marker.

3. The support of claim 1 in which said base member includes an aperture and said plurality of flaps extend outwardly from said base member at the periphery of said aperture.

4. The support of claim 3 in which said plurality of flaps are formed integrally with said base.

5. The support of claim 1 in which said fastening means of holding said element to said base member flaps comprises a plurality of fasteners.

6. The support of claim 1 in which said element comprises a ring-like member.

7. The support of claim 6 in which said element locates in said recess of said upright member.

8. The support of claim 6 in which said base member includes an aperture and said plurality of flaps extend outwardly from said base member at the periphery of said aperture.

9. The support of claim 8 in which said plurality of flaps are formed integrally with said base.

10. The support of claim 6 in which said fastening means of holding said element to said base member flaps comprises a plurality of fasteners.

* * * * *